US007346504B2

(12) United States Patent
Liu et al.

(10) Patent No.: US 7,346,504 B2
(45) Date of Patent: Mar. 18, 2008

(54) MULTI-SENSORY SPEECH ENHANCEMENT USING A CLEAN SPEECH PRIOR

(75) Inventors: Zicheng Liu, Bellevue, WA (US); Alejandro Acero, Bellevue, WA (US); Zhengyou Zhang, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 381 days.

(21) Appl. No.: 11/156,434

(22) Filed: Jun. 20, 2005

(65) Prior Publication Data

US 2006/0287852 A1 Dec. 21, 2006

(51) Int. Cl.
*G10L 21/02* (2006.01)

(52) U.S. Cl. ..... 704/226; 704/228

(58) Field of Classification Search ..... 704/226, 704/228

See application file for complete search history.

(56) References Cited

U.S. PATENT DOCUMENTS

| | | | | |
|---|---|---|---|---|
| 3,383,466 | A | 5/1968 | Hilix et al. | 179/1 |
| 3,746,789 | A | 7/1973 | Alcivar | 179/1 |
| 3,787,641 | A | 1/1974 | Santori | 179/107 |
| 4,382,164 | A | 5/1983 | May, Jr. | 704/233 |
| 4,769,845 | A | 9/1988 | Nakamura | 704/231 |
| 5,054,079 | A | 10/1991 | Frielingsdorf et al. | 381/151 |
| 5,151,944 | A | 9/1992 | Yamamura | 381/151 |
| 5,197,091 | A | 3/1993 | Takagi et al. | 379/433.12 |
| 5,295,193 | A | 3/1994 | Ono | 381/151 |
| 5,404,577 | A | 4/1995 | Zuckerman et al. | 455/66 |
| 5,446,789 | A | 8/1995 | Loy et al. | |
| H1497 | H | 10/1995 | Marshall | 704/276 |
| 5,555,449 | A | 9/1996 | Kim | 379/433.03 |
| 5,590,241 | A | 12/1996 | Park et al. | 704/227 |
| 5,647,834 | A | 7/1997 | Ron | 600/23 |
| 5,692,059 | A | 11/1997 | Kruger | 381/151 |
| 5,701,390 | A | 12/1997 | Griffin et al. | 704/206 |
| 5,757,934 | A | 5/1998 | Yokoi | 381/68.3 |
| 5,812,970 | A | 9/1998 | Chan et al. | 704/226 |
| 5,828,768 | A | 10/1998 | Eatwell et al. | 381/333 |
| 5,873,728 | A | 2/1999 | Jeong | 434/185 |
| 5,933,506 | A | 8/1999 | Aoki et al. | 381/151 |
| 5,943,627 | A | 8/1999 | Kim et al. | 379/426 |
| 5,983,073 | A | 11/1999 | Ditzik | 455/11.1 |
| 5,983,186 | A | 11/1999 | Miyazawa et al. | 704/275 |

(Continued)

FOREIGN PATENT DOCUMENTS

DE 199 17 169 11/2000

(Continued)

OTHER PUBLICATIONS

European Search report from Application No. 05101071.8, filed Feb. 14, 2005.

(Continued)

*Primary Examiner*—David Hudspeth
*Assistant Examiner*—Jakieda Jackson
(74) *Attorney, Agent, or Firm*—Theodore M. Magee; Westman, Champlin & Kelly, P.A.

(57) ABSTRACT

A method and apparatus determine a channel response for an alternative sensor using an alternative sensor signal, an air conduction microphone signal. The channel response and a prior probability distribution for clean speech values are then used to estimate a clean speech value.

17 Claims, 6 Drawing Sheets

U.S. PATENT DOCUMENTS

| | | | | |
|---|---|---|---|---|
| 6,006,175 | A | 12/1999 | Holzrichter | 704/208 |
| 6,028,556 | A | 2/2000 | Shiraki | 343/702 |
| 6,052,464 | A | 4/2000 | Harris et al. | 379/433 |
| 6,052,567 | A | 4/2000 | Ito et al. | 455/90 |
| 6,091,972 | A | 7/2000 | Ogasawara | 455/575.7 |
| 6,094,492 | A | 7/2000 | Boesen | 381/312 |
| 6,125,284 | A | 9/2000 | Moore et al. | 455/557 |
| 6,137,883 | A | 10/2000 | Kaschke et al. | 379/433.07 |
| 6,151,397 | A | 11/2000 | Jackson et al. | 381/71.4 |
| 6,175,633 | B1 | 1/2001 | Morrill et al. | 381/71.6 |
| 6,243,596 | B1 | 6/2001 | Kikinis | 429/8 |
| 6,266,422 | B1 | 7/2001 | Ikeda | 381/71.11 |
| 6,292,674 | B1 | 9/2001 | Davis | 455/550.1 |
| 6,308,062 | B1 | 10/2001 | Chien et al. | 455/420 |
| 6,339,706 | B1 | 1/2002 | Tillgren et al. | 455/419 |
| 6,343,269 | B1 | 1/2002 | Harada et al. | 704/243 |
| 6,377,919 | B1 | 4/2002 | Burnett et al. | 704/231 |
| 6,408,081 | B1 | 6/2002 | Boesen | 381/312 |
| 6,411,933 | B1 | 6/2002 | Maes et al. | 704/273 |
| 6,434,239 | B1 | 8/2002 | DeLuca | 381/71.2 |
| 6,542,721 | B2 | 4/2003 | Boesen | 455/90 |
| 6,560,468 | B1 | 5/2003 | Boesen | 455/568 |
| 6,590,651 | B1 | 7/2003 | Bambot et al. | 356/338 |
| 6,594,629 | B1 | 7/2003 | Basu et al. | 704/251 |
| 6,664,713 | B2 | 12/2003 | Boesen | 310/328 |
| 6,675,027 | B1 | 1/2004 | Huang | 455/575 |
| 6,707,921 | B2 | 3/2004 | Moore | 381/327 |
| 6,717,991 | B1 | 4/2004 | Gustafsson et al. | 375/285 |
| 6,738,485 | B1 * | 5/2004 | Boesen | 381/312 |
| 6,754,358 | B1 | 6/2004 | Boesen et al. | 381/326 |
| 6,760,600 | B2 | 7/2004 | Nickum | 455/557 |
| 6,959,276 | B2 | 10/2005 | Droppo et al. | 704/226 |
| 7,054,423 | B2 | 5/2006 | Nebiker et al. | 379/201.01 |
| 7,110,944 | B2 | 9/2006 | Balan et al. | 704/226 |
| 7,117,148 | B2 | 10/2006 | Droppo et al. | 704/228 |
| 7,181,390 | B2 | 2/2007 | Droppo et al. | 704/226 |
| 7,190,797 | B1 | 3/2007 | Johnston et al. | 381/74 |
| 2001/0027121 | A1 | 10/2001 | Boesen | 455/556 |
| 2001/0039195 | A1 | 11/2001 | Nickum | 455/557 |
| 2001/0044318 | A1 | 11/2001 | Mantyjarvi et al. | 455/550 |
| 2002/0057810 | A1 | 5/2002 | Boesen | |
| 2002/0068537 | A1 | 6/2002 | Shim et al. | 455/177.1 |
| 2002/0075306 | A1 | 6/2002 | Thompson et al. | |
| 2002/0114472 | A1 | 8/2002 | Lee et al. | 381/71.12 |
| 2002/0118852 | A1 | 8/2002 | Boesen | 381/328 |
| 2002/0173953 | A1 | 11/2002 | Frey et al. | 704/226 |
| 2002/0181669 | A1 | 12/2002 | Takatori et al. | |
| 2002/0196955 | A1 | 12/2002 | Boesen | |
| 2002/0198021 | A1 | 12/2002 | Boesen | 455/556 |
| 2003/0061037 | A1 | 3/2003 | Droppo et al. | 704/226 |
| 2003/0083112 | A1 | 5/2003 | Fukuda | 455/568 |
| 2003/0097254 | A1 | 5/2003 | Holzrichter et al. | 704/201 |
| 2003/0125081 | A1 | 7/2003 | Boesen | 455/556 |
| 2003/0144844 | A1 | 7/2003 | Colmenarez et al. | 704/273 |
| 2003/0179888 | A1 | 9/2003 | Burnett et al. | 381/71.8 |
| 2004/0028154 | A1 * | 2/2004 | Yellin et al. | 375/341 |
| 2004/0086137 | A1 | 5/2004 | Yu et al. | 381/71.11 |
| 2004/0092297 | A1 | 5/2004 | Huang | |
| 2004/0186710 | A1 | 9/2004 | Yang | 704/226 |
| 2004/0249633 | A1 | 12/2004 | Asseily et al. | 704/200 |
| 2005/0038659 | A1 | 2/2005 | Helbing | 704/271 |
| 2005/0114124 | A1 | 5/2005 | Liu et al. | |
| 2006/0008256 | A1 | 1/2006 | Khedouri et al. | 386/124 |
| 2006/0009156 | A1 | 1/2006 | Hayes et al. | 455/63.1 |
| 2006/0072767 | A1 | 4/2006 | Zhang et al. | 381/71.6 |
| 2006/0079291 | A1 | 4/2006 | Granovetter et al. | 455/563 |

FOREIGN PATENT DOCUMENTS

| | | | |
|---|---|---|---|
| EP | 0 720 338 | A2 | 7/1996 |
| EP | 742 678 | | 11/1996 |
| EP | 0 854 535 | A2 | 7/1998 |
| EP | 0 939 534 | A1 | 9/1999 |
| EP | 0 951 883 | | 10/1999 |
| EP | 1 333 650 | | 8/2003 |
| EP | 1 569 422 | | 8/2005 |
| FR | 2 761 800 | | 4/1997 |
| GB | 2 375 276 | | 11/2002 |
| GB | 2 390 264 | | 12/2003 |
| JP | 3108997 | | 5/1991 |
| JP | 4245720 | | 9/1992 |
| JP | 5276587 | | 10/1993 |
| JP | 8065781 | | 3/1996 |
| JP | 8070344 | | 3/1996 |
| JP | 8079868 | | 3/1996 |
| JP | 8214391 | | 8/1996 |
| JP | 9284877 | | 10/1997 |
| JP | 10-023122 | | 1/1998 |
| JP | 10-023123 | | 1/1998 |
| JP | 11265199 | | 9/1999 |
| JP | 2001119797 | | 10/1999 |
| JP | 2001245397 | | 2/2000 |
| JP | 20002-09688 | | 7/2000 |
| JP | 2000196723 | | 7/2000 |
| JP | 2000250577 | | 9/2000 |
| JP | 2000261529 | | 9/2000 |
| JP | 2000261530 | | 9/2000 |
| JP | 2000261534 | | 9/2000 |
| JP | 2000354284 | | 12/2000 |
| JP | 2001292489 | | 10/2001 |
| JP | 2002-125298 | | 4/2002 |
| JP | 2002-358089 | | 12/2002 |
| JP | 2003143253 | | 5/2003 |
| WO | WO 93/01664 | | 1/1993 |
| WO | WO 95/17746 | | 6/1995 |
| WO | WO 00/21194 | | 10/1998 |
| WO | WO 99/04500 | | 1/1999 |
| WO | WO 00/21194 | | 4/2000 |
| WO | WO 00/45248 | | 8/2000 |
| WO | WO 02/07477 | | 1/2002 |
| WO | WO 02/098169 | A1 | 5/2002 |
| WO | WO 02/077972 | A1 | 10/2002 |
| WO | WO 03/055270 | A1 | 7/2003 |
| WO | WO 2004/012477 | | 2/2004 |

OTHER PUBLICATIONS

European Search report from Application No. 04025457.5, filed Oct. 26, 2004.

Written Opinion from Application No. SG 200500289-7, filed Jan. 18, 2005.

Chilean Office Action from Application No. 121-2005, filed Jan. 21, 2005.

RD 418033, Feb. 10, 1999.

Australian Search Report and Written Opinion for Foreign Application No. SG 200500289-4 filed Jan. 18, 2005.

Bakar, "The Insight of Wireless Communication," Research and Development, 2002, Student Conference on Jul. 16-17, 2002.

Search Report dated Dec. 17, 2004 from International Application No. 04016226.5.

European Search Report from Application No. 05107921.8, filed Aug. 30, 2005.

European Search Report from Application No. 05108871.4, filed Sep. 26, 2005.

http://www.snaptrack.com/ (2004).

http://www.misumi.com.tw/PLIST.ASP?PC.ID:21 (2004).

http://www.wherifywireless.com/univLoc.asp (2001).

http://www.wherifywireless.com/prod.watches.htm (2001).

Microsoft Office, Live Communications Server 2003, Microsoft Corporation, pp. 1-10, 2003.

Shoshana Berger, http://www.cnn.com/technology, "Wireless, wearable, and wondrous tech," Jan. 17, 2003.

http://www.3G.co.uk, "NTT DoCoMo to Introduce First Wireless GPS Handset," Mar. 27, 2003.

"Physiological Monitoring System 'Lifeguard' System Specifications," Stanford University Medican Center, National Biocomputation Center, Nov. 8, 2002.

Nagl, L., "Wearable Sensor System for Wireless State-of-Health Determination in Cattle," Annual International Conference of the Institute of Electrical and Electronics Engineers' Engineering in Medicine and Biology Society, 2003.

Asada, H. and Barbagelata, M., "Wireless Fingernail Sensor for Continuous Long Term Health Monitoring," MIT Home Automation and Healthcare Consortium, Phase 3, Progress Report No. 3-1, Apr. 2001.

Kumar, V., "The Design and Testing of a Personal Health System to Motivate Adherence to Intensive Diabetes Management," Harvard-MIT Division of Health Sciences and Technology, pp. 1-66, 2004.

Zheng Y. et al., "Air and Bone-Conductive Integrated Microphones for Robust Speech Detection and Enhancement" Automatic Speech Recognition and Understanding 2003. pp. 249-254.

De Cuetos P. et al. "Audio-visual intent-to-speak detection for human-computer interaction" vol. 6, Jun. 5, 2000. pp. 2373-2376.

M. Graciarena, H. Franco, K. Sonmez, and H. Bratt, "Combining Standard and Throat Microphones for Robust Speech Recognition," IEEE Signal Processing Letters, vol. 10, No. 3, pp. 72-74, Mar. 2003.

P. Heracleous, Y. Nakajima, A. Lee, H. Saruwatari, K. Shikano, "Accurate Hidden Markov Models for Non-Audible Murmur (NAM) Recognition Based on Iterative Supervised Adaptation," ASRU 2003, St. Thomas, U.S. Virgin Islands, Nov. 20-Dec. 4, 2003.

O.M. Strand, T. Holter, A. Egeberg, and S. Stensby, "On the Feasibility of ASR in Extreme Noise Using the PARAT Earplug Communication Terminal," ASRU 2003, St. Thomas, U.S. Virgin Islands, Nov. 20-Dec. 4, 2003.

Z. Zhang, Z. Liu, M. Sinclair, A. Acero, L. Deng, J. Droppo, X. D. Huang, Y. Zheng, "Multi-Sensory Microphones For Robust Speech Detection, Enchantment, and Recognition," ICASSP 04, Montreal, May 17-21, 2004.

U.S. Appl. No. 10/629,278, filed Jul. 29, 2003, Huang et al.

U.S. Appl. No. 10/785,768, filed Feb. 24, 2004, Sinclair et al.

U.S. Appl. No. 10/636,176, filed Aug. 7, 2003, Huang et al.

* cited by examiner

MULTI-SENSORY SPEECH ENHANCEMENT USING A CLEAN SPEECH PRIOR

BACKGROUND

A common problem in speech recognition and speech transmission is the corruption of the speech signal by additive noise. In particular, corruption due to the speech of another speaker has proven to be difficult to detect and/or correct.

Recently, a system has been developed that attempts to remove noise by using a combination of an alternative sensor, such as a bone conduction microphone, and an air conduction microphone. This system is trained using three training channels: a noisy alternative sensor training signal, a noisy air conduction microphone training signal, and a clean air conduction microphone training signal. Each of the signals is converted into a feature domain. The features for the noisy alternative sensor signal and the noisy air conduction microphone signal are combined into a single vector representing a noisy signal. The features for the clean air conduction microphone signal form a single clean vector. These vectors are then used to train a mapping between the noisy vectors and the clean vectors. Once trained, the mappings are applied to a noisy vector formed from a combination of a noisy alternative sensor test signal and a noisy air conduction microphone test signal. This mapping produces a clean signal vector.

This system is less than optimal when the noise conditions of the test signals do not match the noise conditions of the training signals because the mappings are designed for the noise conditions of the training signals.

SUMMARY

A method and apparatus determine a channel response for an alternative sensor using an alternative sensor signal, an air conduction microphone signal. The channel response and a prior probability distribution for clean speech values are then used to estimate a clean speech value.

DETAILED DESCRIPTION OF ILLUSTRATIVE EMBODIMENTS

Figure 1:
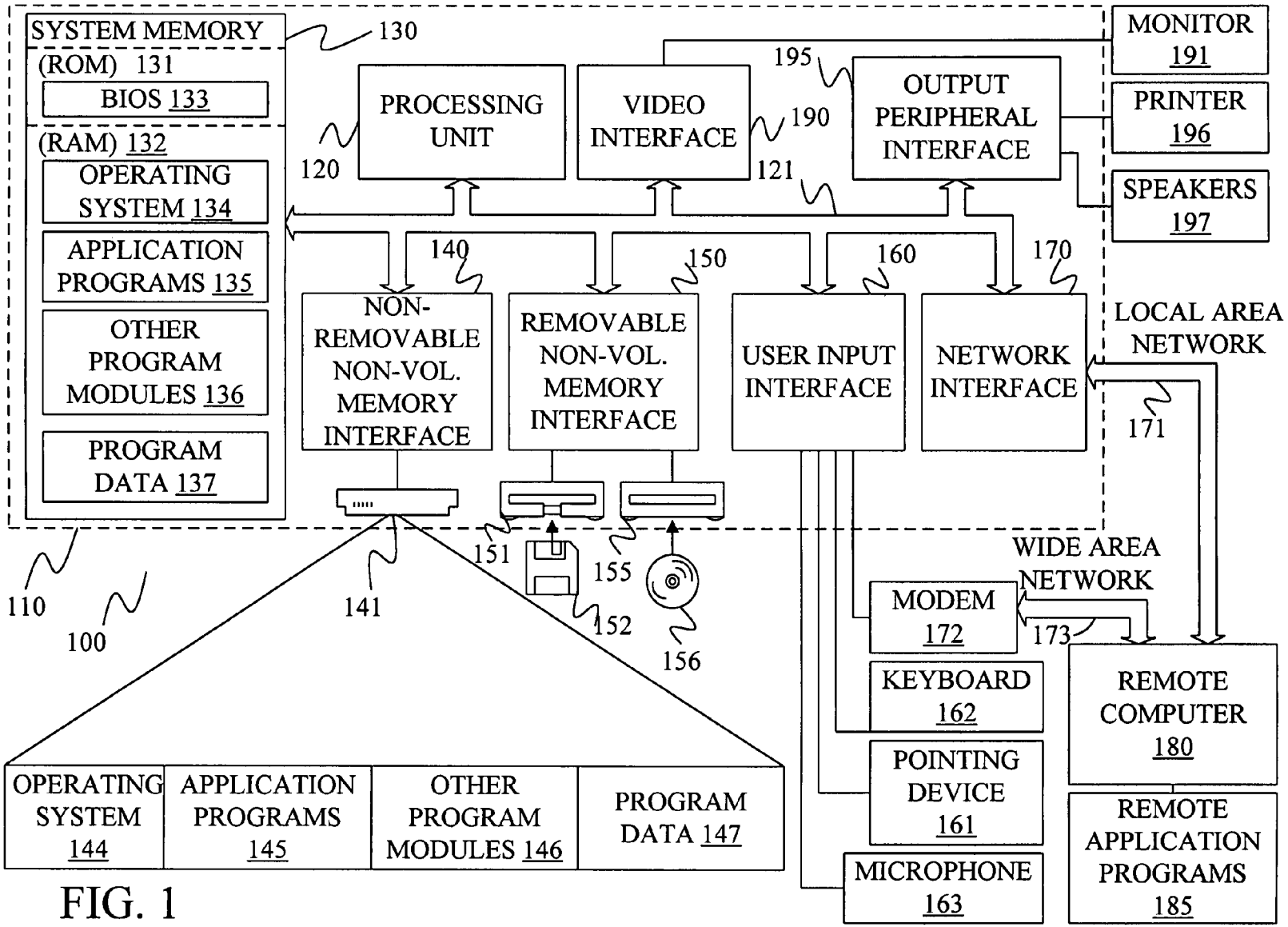
FIG. 1 is a block diagram of one computing environment in which embodiments of the present invention may be practiced.

FIG. 1 illustrates an example of a suitable computing system environment 100 on which embodiments of the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well-known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, telephony systems, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. The invention is designed to be practiced in distributed computing environments where tasks are performed by remote processing devices that are linked through a communications network. In a distributed computing environment, program modules are located in both local and remote computer storage media including memory storage devices.

With reference to FIG. 1, an exemplary system for implementing embodiments of the invention includes a general-purpose computing device in the form of a computer 110. Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 110. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies.

A user may enter commands and information into the computer 110 through input devices such as a keyboard 162, a microphone 163, and a pointing device 161, such as a mouse, trackball or touch pad. Other input devices (not shown) may include a joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device is also connected to the system bus 121 via an interface, such as a video interface 190. In addition to the monitor, computers may also include other peripheral output devices such as speakers 197 and printer 196, which may be connected through an output peripheral interface 195.

The computer 110 is operated in a networked environment using logical connections to one or more remote computers, such as a remote computer 180. The remote computer 180 may be a personal computer, a hand-held device, a server, a router, a network PC, a peer device or other common network node, and typically includes many or all of the elements described above relative to the computer 110. The logical connections depicted in FIG. 1 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on remote computer 180. It will be appreciated that the network connections shown are exemplary and other means of establishing a communications link between the computers may be used.

Figure 2:
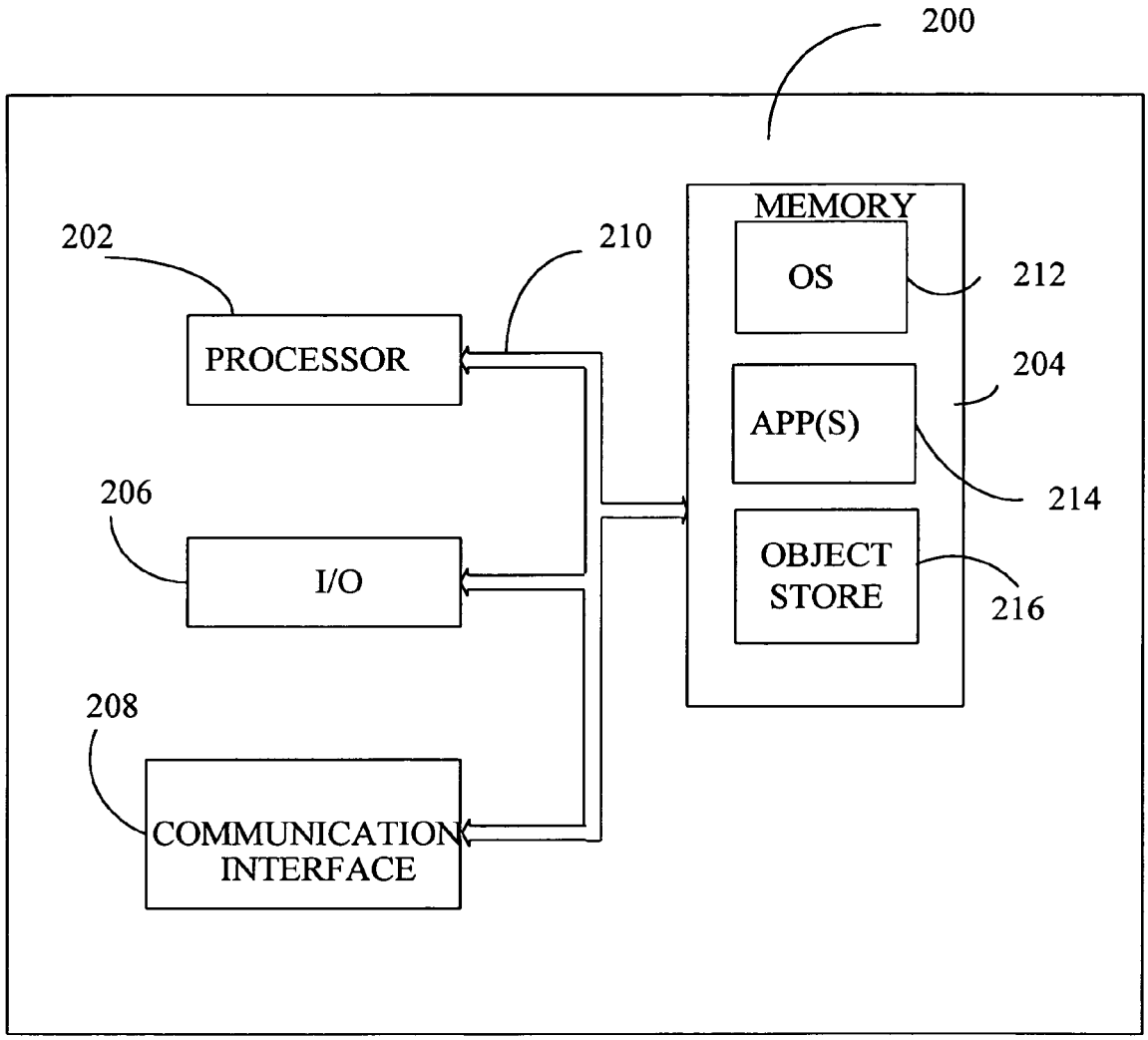
FIG. 2 is a block diagram of an alternative computing environment in which embodiments of the present invention may be practiced.

FIG. 2 is a block diagram of a mobile device 200, which is an exemplary computing environment. Mobile device 200 includes a microprocessor 202, memory 204, input/output (I/O) components 206, and a communication interface 208 for communicating with remote computers or other mobile devices. In one embodiment, the afore-mentioned components are coupled for communication with one another over a suitable bus 210.

Memory 204 is implemented as non-volatile electronic memory such as random access memory (RAM) with a battery back-up module (not shown) such that information stored in memory 204 is not lost when the general power to mobile device 200 is shut down. A portion of memory 204 is preferably allocated as addressable memory for program execution, while another portion of memory 204 is preferably used for storage, such as to simulate storage on a disk drive.

Memory 204 includes an operating system 212, application programs 214 as well as an object store 216. During operation, operating system 212 is preferably executed by processor 202 from memory 204. Operating system 212, in one preferred embodiment, is a WINDOWS® CE brand operating system commercially available from Microsoft Corporation. Operating system 212 is preferably designed for mobile devices, and implements database features that can be utilized by applications 214 through a set of exposed application programming interfaces and methods. The objects in object store 216 are maintained by applications 214 and operating system 212, at least partially in response to calls to the exposed application programming interfaces and methods.

Communication interface 208 represents numerous devices and technologies that allow mobile device 200 to send and receive information. The devices include wired and wireless modems, satellite receivers and broadcast tuners to name a few. Mobile device 200 can also be directly connected to a computer to exchange data therewith. In such cases, communication interface 208 can be an infrared transceiver or a serial or parallel communication connection, all of which are capable of transmitting streaming information.

Input/output components 206 include a variety of input devices such as a touch-sensitive screen, buttons, rollers, and a microphone as well as a variety of output devices including an audio generator, a vibrating device, and a display. The devices listed above are by way of example and need not all be present on mobile device 200. In addition, other input/output devices may be attached to or found with mobile device 200 within the scope of the present invention.

Figure 3:
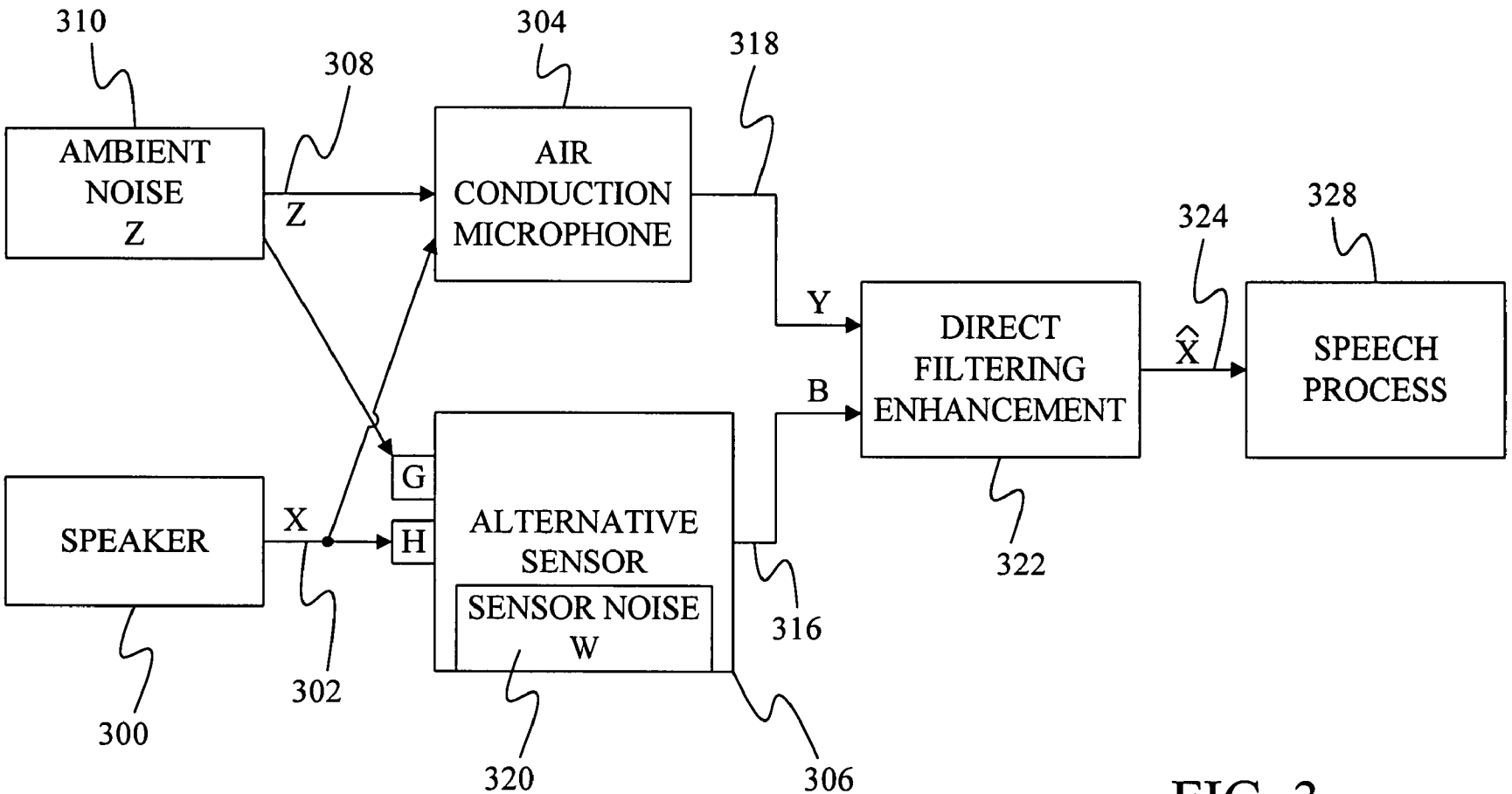
FIG. 3 is a block diagram of a general speech processing system of one embodiment of the present invention.

FIG. 3 provides a basic block diagram of embodiments of the present invention. In FIG. 3, a speaker 300 generates a speech signal 302 (X) that is detected by an air conduction microphone 304 and an alternative sensor 306. Examples of alternative sensors include a throat microphone that measures the user's throat vibrations, a bone conduction sensor that is located on or adjacent to a facial or skull bone of the user (such as the jaw bone) or in the ear of the user and that senses vibrations of the skull and jaw that correspond to speech generated by the user. Air conduction microphone 304 is the type of microphone that is used commonly to convert audio air-waves into electrical signals.

Air conduction microphone 304 also receives ambient noise 308 (Z) generated by one or more noise sources 310. Depending on the type of ambient noise and the level of the ambient noise, ambient noise 308 may also be detected by alternative sensor 306. However, under embodiments of the present invention, alternative sensor 306 is typically less sensitive to ambient noise than air conduction microphone 304. Thus, the alternative sensor signal 316 (B) generated by alternative sensor 306 generally includes less noise than air conduction microphone signal 318 (Y) generated by air conduction microphone 304. Although alternative sensor 306 is less sensitive to ambient noise, it does generate some sensor noise 320 (W).

The path from speaker 300 to alternative sensor signal 316 can be modeled as a channel having a channel response H. The path from ambient noise 308 to alternative sensor signal 316 can be modeled as a channel having a channel response G.

Alternative sensor signal 316 (B) and air conduction microphone signal 318 (Y) are provided to a clean signal estimator 322, which estimates a clean signal 324. Clean signal estimate 324 is provided to a speech process 328. Clean signal estimate 324 may either be a filtered time-domain signal or a Fourier Transform vector. If clean signal estimate 324 is a time-domain signal, speech process 328 may take the form of a listener, a speech coding system, or a speech recognition system. If clean signal estimate 324 is a Fourier Transform vector, speech process 328 will typically be a speech recognition system, or contain an Inverse Fourier Transform to convert the Fourier Transform vector into waveforms.

Figure 4:
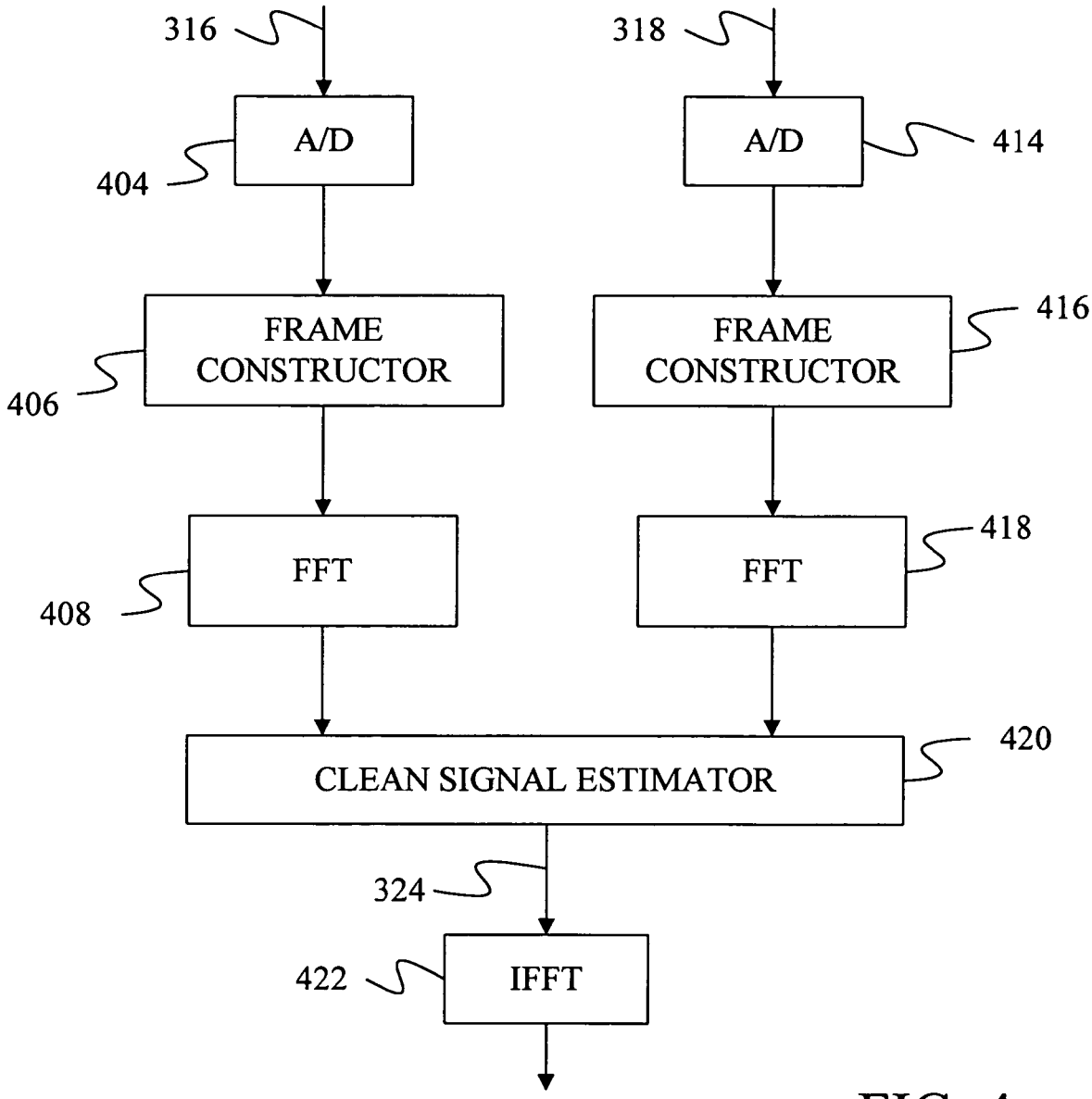
FIG. 4 is a block diagram of a system for enhancing speech under one embodiment of the present invention.

Within direct filtering enhancement 322, alternative sensor signal 316 and microphone signal 318 are converted into the frequency domain being used to estimate the clean speech. As shown in FIG. 4, alternative sensor signal 316 and air conduction microphone signal 318 are provided to analog-to-digital converters 404 and 414, respectively, to generate a sequence of digital values, which are grouped into frames of values by frame constructors 406 and 416, respectively. In one embodiment, A-to-D converters 404 and 414 sample the analog signals at 16 kHz and 16 bits per sample, thereby creating 32 kilobytes of speech data per second and frame constructors 406 and 416 create a new respective frame every 10 milliseconds that includes 20 milliseconds worth of data.

Each respective frame of data provided by frame constructors 406 and 416 is converted into the frequency domain using Fast Fourier Transforms (FFT) 408 and 418, respectively.

The frequency domain values for the alternative sensor signal and the air conduction microphone signal are provided to clean signal estimator 420, which uses the frequency domain values to estimate clean speech signal 324.

Under some embodiments, clean speech signal 324 is converted back to the time domain using Inverse Fast Fourier Transforms 422. This creates a time-domain version of clean speech signal 324.

Embodiments of the present invention provide direct filtering techniques for estimating clean speech signal 324. Under direct filtering, a maximum likelihood estimate of the channel response(s) for alternative sensor 306 are determined by minimizing a function relative to the channel response(s). These estimates are then used to determine a maximum likelihood estimate of the clean speech signal by minimizing a function relative to the clean speech signal.

Under one embodiment of the present invention, the channel response G corresponding to background speech being detected by the alternative sensor is considered to be zero. This results in a model between the clean speech signal and the air conduction microphone signal and alternative sensor signal of:

$$y(t)=x(t)+z(t) \quad \text{Eq. 1}$$

$$b(t)=h(t)*x(t)+w(t) \quad \text{Eq. 2}$$

where y(t) is the air conduction microphone signal, b(t) is the alternative sensor signal, x(t) is the clean speech signal, z(t) is the ambient noise, w(t) is the alternative sensor noise, and h(t) is the channel response to the clean speech signal associated with the alternative sensor. Thus, in Equation 2, the alternative sensor signal is modeled as a filtered version of the clean speech, where the filter has an impulse response of h(t).

In the frequency domain, Equations 1 and 2 can be expressed as:

$$Y_t(k)=X_t(k)+Z_t(k) \quad \text{Eq. 3}$$

$$B_t(k)=H_t(k)X_t(k)+W_t(k) \quad \text{Eq. 4}$$

where the notation $Y_t(k)$ represents the kth frequency component of a frame of a signal centered around time t. This notation applies to $X_t(k)$, $Z_t(k)$, $H_t(k)$, $W_t(k)$, and $B_t(k)$. In the discussion below, the reference to frequency component k is omitted for clarity. However, those skilled in the art will recognize that the computations performed below are performed on a per frequency component basis.

Under this embodiment, the real and imaginary parts of the noise $Z_t$ and $W_t$ are modeled as independent zero-mean Gaussians such that:

$$Z_t=N(O,\sigma_z^2) \quad \text{Eq. 5}$$

$$W_t=N(O,\sigma_w^2) \quad \text{Eq. 6}$$

where $\sigma_z^2$ is the variance for noise $Z_t$ and $\sigma_w^2$ is the variance for noise $W_t$.

$H_t$ is also modeled as a Gaussian such that $$H_t=N(H_0,\sigma_H^2) \quad \text{Eq. 7}$$

where $H_0$ is the mean of the channel response and $\sigma_H^2$ is the variance of the channel response.

Given these model parameters, the probability of a clean speech value $X_t$ and a channel response value $H_t$ is described by the conditional probability:

$$p(X_{t,H_t|Y_t,B_t,H_0},\sigma_z^2,\sigma_w^2,\sigma_H^2) \quad \text{Eq. 8}$$

which is proportional to:

$$p(Y_{t,B_t|X_t,H_t}\sigma_z^2\sigma_w^2)p(H_{t|H_0}\sigma_H^2)p(X_t) \quad \text{Eq. 9}$$

which is equal to:

$$p(Y_{t|X_t},\sigma_z^2)p(B_{t|X_t,H_t},\sigma_w^2)p(H_{t|H_0},\sigma_H^2)p(X_t) \quad \text{Eq. 10}$$

In one embodiment, the prior probability for the channel response, $p(H_t|H_0\sigma_H^2)$, is ignored and each of the remaining probabilities is treated as a Gaussian distribution with the prior probability of clean speech, $p(X_t)$, being treated as a zero mean Gaussian with a variance $\sigma_{x,t}^2$ such that:

$$X_t=N(0,\sigma_{x,t}^2) \quad \text{Eq. 11}$$

Using this simplification and Equation 10, the maximum likelihood estimate of $X_t$ for the frame at t is determined by minimizing:

$$F_t = \frac{1}{2\sigma_z^2}|Y_t - X_t|^2 + \frac{1}{2\sigma_w^2}|B_t - H_t X_t|^2 + \frac{|X_t|^2}{2\sigma_{x,t}^2} \quad \text{Eq. 12}$$

Since Equation 12 is being minimized with respect to $X_t$, the partial derivative with respect to $X_t$ may be taken to determine the value of $X_t$ that minimizes the function. Specifically, $$\frac{\partial F}{\partial X_t} = 0$$

gives:

$$X_t = \frac{\sigma_{x,t}^2(\sigma_w^2 Y_t + \sigma_z^2 H_t^* B_t)}{\sigma_{x,t}^2(\sigma_w^2 + \sigma_z^2|H_t|^2)+\sigma_z^2\sigma_w^2} \quad \text{Eq. 13}$$

where $H_t^*$ represent the complex conjugate of $H_t$ and $|H_t|$ represents the magnitude of the complex value $H_t$.

The channel response $H_t$ is estimated from the whole utterance by minimizing:

$$F = \sum_{t=1}^{T}\left(\frac{1}{2\sigma_z^2}|Y_t - X_t|^2 + \frac{1}{2\sigma_w^2}|B_t - H_t X_t|^2\right) \quad \text{Eq. 14}$$

Substituting the expression of $X_t$ calculated in Equation 13 into Equation 14, setting the partial derivative $$\frac{\partial F}{\partial H_t} = 0,$$

and then assuming that H is constant across all time frames T gives a solution for H of:

$$H = \frac{\sum_{t=1}^{T}(\sigma_z^2|B_t|^2 - \sigma_w^2|Y_t|^2) \pm \sqrt{\left(\sum_{t=1}^{T}(\sigma_z^2|B_t|^2 - \sigma_w^2|Y_t|^2)\right)^2 + 4\sigma_z^2\sigma_w^2\left|\sum_{t=1}^{T}B_t^* Y_t\right|^2}}{2\sigma_z^2\sum_{t=1}^{T}B_t^* Y_t} \quad \text{Eq. 15}$$

In Equation 15, the estimation of H requires computing several summations over the last T frames in the form of:

$$S(T) = \sum_{t=1}^{T} s_t \quad \text{Eq. 16}$$

where $s_t$ is $(\sigma_z^2|B_t|^2-\sigma_w^2|Y_t|^2)$_or $B_t^*Y_t$

With this formulation, the first frame (t=1) is as important as the last frame (t=T). However, in other embodiments it is preferred that the latest frames contribute more to the estimation of H than the older frames. One technique to achieve this is "exponential aging", in which the summations of Equation 16 are replaced with:

$$S(T) = \sum_{t=1}^{T} c^{T-t} s_t \quad \text{Eq. 17}$$

where $c \leqq 1$. If c=1, then Equation 17 is equivalent to Equation 16. If c<1, then the last frame is weighted by 1, the before-last frame is weighted by c (i.e., it contributes less than the last frame), and the first frame is weighted by $c^{T-1}$ (i.e., it contributes significantly less than the last frame). Take an example. Let c=0.99 and T=100, then the weight for the first frame is only $0.99^{99}=0.37$.

Under one embodiment, Equation 17 is estimated recursively as $$S(T)=cS(T-1)+s_T \quad \text{Eq. 18}$$

Since Equation 18 automatically weights old data less, a fixed window length does not need to be used, and data of the last T frames do not need to be stored in the memory. Instead, only the value for S(T−1) at the previous frame needs to be stored.

Using Equation 18, Equation 15 becomes:

$$H_T = \frac{J(T) \pm \sqrt{(J(T))^2 + 4\sigma_z^2\sigma_w^2|K(T)|^2}}{2\sigma_z^2 K(T)} \quad \text{Eq. 19}$$

where:

$$J(T)=cJ(T-1)+(\sigma_z^2|B_T|^2-\sigma_w^2|Y_T|^2) \quad \text{Eq. 20}$$

$$K(T)=cK(T-1)+B_T^*Y_T \quad \text{Eq. 21}$$

The value of c in equations 20 and 21 provides an effective length for the number of past frames that are used to compute the current value of J(T) and K(T). Specifically, the effective length is given by:

$$L(T) = \sum_{t=1}^{T} c^{T-t} = \sum_{i=0}^{T-1} c^{i} = \frac{1-c^{T}}{1-c} \quad \text{Eq. 22}$$

The asymptotic effective length is given by:

$$L = \lim_{T\to\infty} L(T) = \frac{1}{1-c} \quad \text{Eq. 23}$$

or equivalently, $$c = \frac{L-1}{L} \quad \text{Eq. 24}$$

Thus, using equation 24, c can be set to achieve different effective lengths in equation 19. For example, to achieve an effective length of 200 frames, c is set as:

$$c = \frac{199}{200} = 0.995 \quad \text{Eq. 25}$$

Once H has been estimated using Equation 15, it may be used in place of all $H_t$ of Equation 13 to determine a separate value of $X_t$ at each time frame t. Alternatively, equation 19 may be used to estimate $H_t$ at each time frame t. The value of $H_t$ at each frame is then used in Equation 13 to determine $X_t$.

Figure 5:
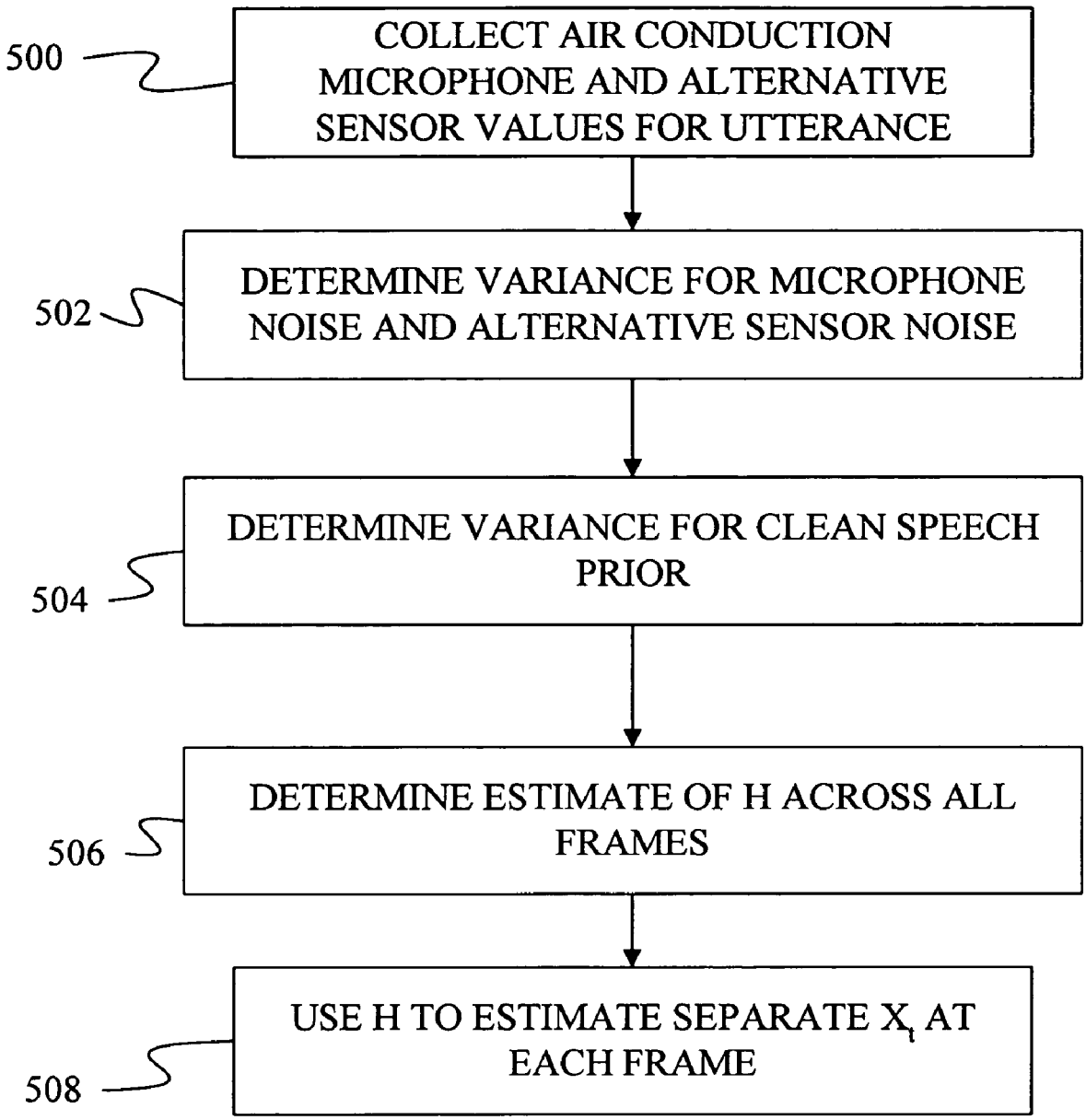
FIG. 5 is a flow diagram for enhancing speech under one embodiment of the present invention.

FIG. 5 provides a flow diagram of a method of the present invention that uses Equations 13 and 15 to estimate a clean speech value for an utterance.

At step 500, frequency components of the frames of the air conduction microphone signal and the alternative sensor signal are captured across the entire utterance.

At step 502 the variance for ambient noise $\sigma_z^2$ and the alternative sensor noise $\sigma_w^2$ is determined from frames of the air conduction microphone signal and alternative sensor signal, respectively, that are captured early in the utterance during periods when the speaker is not speaking.

The method determines when the speaker is not speaking by identifying low energy portions of the alternative sensor signal, since the energy of the alternative sensor noise is much smaller than the speech signal captured by the alternative sensor signal. In other embodiments, known speech detection techniques may be applied to the air conduction speech signal to identify when the speaker is speaking. During periods when the speaker is not considered to be speaking, $X_t$ is assumed to be zero and any signal from the air conduction microphone or the alternative sensor is considered to be noise. Samples of these noise values are collected from the frames of non-speech and are used to estimate the variance of the noise in the air conduction signal and the alternative sensor signal.

At step 504, the variance of the clean speech prior probability distribution, $\sigma_{x,t}^2$, is determined. Under one embodiment, this variance is computed as:

$$\sigma_{x,t}^2 = \frac{1}{(m+k+1)} \sum_{d=t-k}^{t+m} |Y_d|^2 - \sigma_z^2 \quad \text{Eq. 26}$$

where $|Y_d|^2$ is the energy of the air conduction microphone signal and the summation is performed over a set of speech frames that includes the k speech frames before the current speech frame and the m speech frames after the current speech frame. To avoid a negative value or a value of zero for the variance, $\sigma_{x,t}^2$, some embodiments of the present invention use $(0.01\cdot\sigma_z^2)$ as the lowest possible value for $\sigma_{x,t}^2$.

In an alternative embodiment, a real-time implementation is realized using a smoothing technique that relies only on the variance of the clean speech signal in the preceding frame of speech such that:

$$\sigma_{x,t}^2 = p\max(|Y_d|^2-\sigma_z^2, \alpha|Y_d|^2)+(1-p)\sigma_{x,t-1}^2 \quad \text{Eq. 27}$$

where $\sigma_{x,t-1}^2$ is the variance of the clean speech prior probability distribution from the last frame that contained speech, p is a smoothing factor with a range between 0 and 1, $\alpha$ is a small constant, and $\max(|Y_d|^2-\sigma_z^2, \alpha|Y_d|^2)$ indicates that the larger of $|Y_d|^2-\sigma_z^2$ and $\alpha|Y_d|^2$ is selected to insure positive values for $\sigma_{x,t}^2$. Under one specific embodiment, the smoothing factor has a value of 0.08, and $\alpha$=0.01.

At step 506, the values for the alternative sensor signal and the air conduction microphone signal across all of the frames of the utterance are used to determine a value of H using Equation 15 above. At step 508, this value of H is used together with the individual values of the air conduction microphone signal and the alternative sensor signal at each time frame to determine an enhanced or noise-reduced speech value for each time frame using Equation 13 above.

In other embodiments, instead of using all of the frames of the utterance to determine a single value of H using Equation 15, $H_t$ is determined for each frame using Equation 19. The value of $H_t$ is then used to compute $X_t$ for the frame using Equation 13 above.

In a second embodiment of the present invention, the channel response of the alternative sensor to ambient noise is considered to be non-zero. In this embodiment, the air conduction microphone signal and the alternative sensor signal are modeled as:

$$Y_t(k)=X_t(k)+Z_t(k) \quad \text{Eq. 28}$$

$$B_t(k)=H_t(k)X_t(k)+G_t(k)Z_t(k)+W_t(K) \quad \text{Eq. 29}$$

where the alternative sensors channel response to the ambient noise is a non-zero value of $G_t(k)$.

The maximum likelihood for the clean speech $X_t$ can be found by minimizing an objective function resulting in an equation for the clean speech of:

$$X_t = \frac{\sigma_{x,t}^2(\sigma_w^2 Y_t + \sigma_z^2(H-G)*(B_t - GY_t)}{\sigma_{x,t}^2(\sigma_w^2 + \sigma_z^2|H-G|^2) + \sigma_z^2\sigma_w^2} \quad \text{Eq. 30}$$

Figure 6:
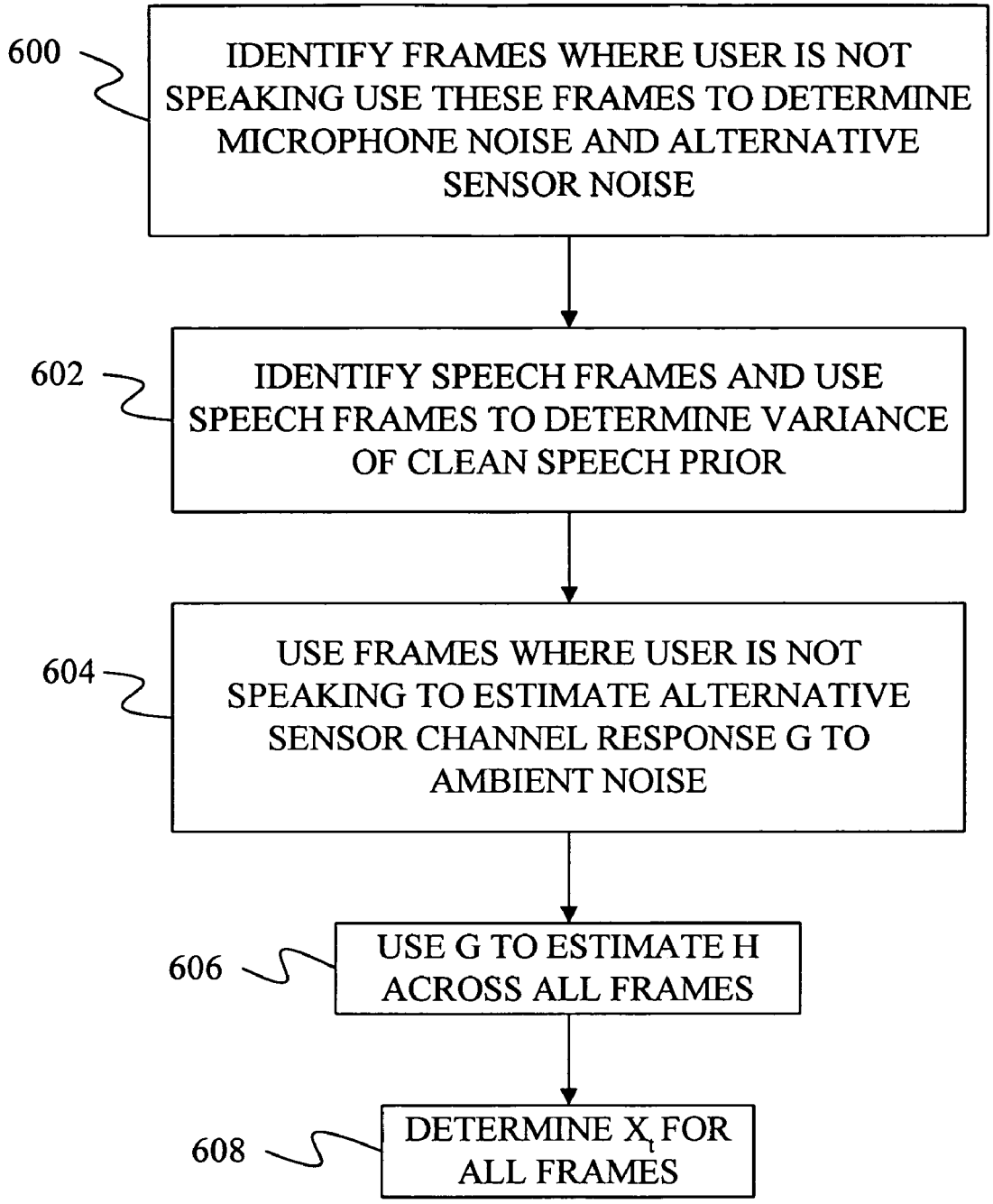
FIG. 6 is a flow diagram for enhancing speech under another embodiment of the present invention.

In order to solve Equation 30, the variances $\sigma_{x,t}^2$, $\sigma_w^2$ and $\sigma_z^2$ as well as the channel response values H and G must be known. FIG. 6 provides a flow diagram for identifying these values and for determining enhanced speech values for each frame.

In step 600, frames of the utterance are identified where the user is not speaking. These frames are then used to determine the variance $\sigma_w^2$ and $\sigma_z^2$ for the alternative sensor and the ambient noise, respectively.

To identify frames where the user is not speaking, the alternative sensor signal can be examined. Since the alternative sensor signal will produce much smaller signal values for background speech than for noise, if the energy of the alternative sensor signal is low, it can be assumed that the speaker is not speaking.

After the variances for the ambient noise and the alternative sensor noise have been determined, the method of FIG. 6 continues at step 602 where it determines the variance of the clean speech prior probability, $\sigma_{x,t}^2$, using equations 26 or 27 above. As discussed above, only those frames containing speech are used to determine the variance of the clean speech prior.

At step 604, the frames identified where the user is not speaking are used to estimate the alternative sensor's channel response G for ambient noise. Specifically, G is determined as:

$$G = \frac{\sum_{t=1}^{D} Y * B}{\sum_{t=1}^{D} Y * Y} \quad \text{Eq. 31}$$

Where D is the number of frames in which the user is not speaking. In Equation 31, it is assumed that G remains constant through all frames of the utterance and thus is no longer dependent on the time frame t. In equation 31, the summation over t may be replaced with the exponential decay calculation discussed above in connection with equations 16-25.

At step 606, the value of the alternative sensor's channel response G to the background speech is used to determine the alternative sensor's channel response to the clean speech signal. Specifically, H is computed as:

$$H = G + \frac{\sum_{t=1}^{T} (\sigma_z^2 |B_t - GY_t|^2 - \sigma_w^2 |Y_t|^2) \pm \sqrt{\left(\sum_{t=1}^{T} (\sigma_z^2 |B_t - GY_t|^2 - \sigma_w^2 |Y_t|^2)\right)^2 + 4\sigma_z^2 \sigma_w^2 \left|\sum_{t=1}^{T} (B_t - GY_t) * Y_t\right|^2}}{\left(2\sigma_z^2 \sum_{t=1}^{T} (B_t - GY_t) * Y_t\right)} \quad \text{Eq. 32}$$

In Equation 32, the summation over T may be replaced with the recursive exponential decay calculation discussed above in connection with equations 16-25.

After H has been determined at step 606, Equation 30 may be used to determine a clean speech value for all of the frames. In using Equation 30, under some embodiments, the term $B_t - GY_t$ is replaced with $$\left(1 - \frac{|GY_t|}{|B_t|}\right) B_t$$

because it has been found to be difficult to accurately determine the phase difference between the background speech and its leakage into the alternative sensor.

If the recursive exponential decay calculation is used in place of the summations in Equation 32, a separate value of $H_t$ may be determined for each time frame and may be used as H in equation 30.

Although the present invention has been described with reference to particular embodiments, workers skilled in the art will recognize that changes may be made in form and detail without departing from the spirit and scope of the invention.

What is claimed is:

1. A method of determining an estimate for a noise-reduced value representing a portion of a noise-reduced speech signal, the method comprising:

generating an alternative sensor signal using an alternative sensor other than an air conduction microphone;

generating an air conduction microphone signal;

using the alternative sensor signal and the air conduction microphone signal to estimate a value for a channel response of the alternative sensor signal; and using the channel response and a prior probability distribution of the noise-reduced value to estimate the noise-reduced value.

2. The method of claim 1 wherein the prior probability distribution of the noise reduced value is defined by a variance.

3. The method of claim 2 further comprising determining the variance of the distribution based on the air conduction microphone signal.

4. The method of claim 3 wherein determining the variance based on the air conduction microphone signal comprises forming a sum of energy values for frames of the air conduction microphone signal.

5. The method of claim 4 wherein the frames of the air conduction microphone signal all contain speech.

6. The method of claim 3 wherein determining the variance of the distribution further comprises determining the variance based on a variance of ambient noise.

7. The method of claim 6 wherein determining the variance of the distribution further comprises determining a variance associated with a current frame of the noise-reduced speech signal based on a current frame of the air conduction microphone signal and a variance of the distribution associated with a preceding frame of the noise-reduced speech signal.

8. The method of claim 7 wherein determining the variance of the distribution further comprises limiting the values of the variance so that the variance always exceeds some minimum value.

9. The method of claim 8 wherein the minimum value is a percentage of the variance of the ambient noise.

10. A computer-readable storage medium having computer-executable instructions for performing steps comprising:

determining a channel response for an alternative sensor using an alternative sensor signal and an air conduction microphone signal;

determining a variance for a prior probability distribution for a clean speech value based on the air conduction microphone signal; and using the channel response and the variance for the prior probability distribution for a clean speech value to estimate a clean speech value.

11. The computer-readable storage medium of claim 10 wherein determining the variance for the prior probability distribution further comprises determining the variance for the prior probability distribution based on a distribution of ambient noise.

12. The computer-readable storage medium of claim 11 wherein determining the variance for the prior probability distribution based on the air conduction microphone signal comprises forming a sum of energy values for frames of the air conduction microphone signal.

13. The computer-readable storage medium of claim 11 wherein determining the variance for the prior probability distribution further comprises determining a variance for the prior probability distribution associated with a current clean speech value based on a variance for a prior probability distribution associated with an earlier clean speech value.

14. The computer-readable storage medium of claim 13 wherein determining the variance of the prior probability distribution further comprises taking a weighted sum of the variance for a prior probability distribution associated with an earlier clean speech value and the difference between the energy of a frame of the air conduction microphone signal and the variance of the distribution of ambient noise.

15. The computer-readable storage medium of claim 10 wherein determining the variance of the prior probability distribution further comprises setting a minimum value for the variance of the prior probability distribution.

16. The computer-readable storage medium of claim 15 wherein the minimum value for the variance is a function of a variance for a distribution of ambient noise.

17. A method of identifying a clean speech value for a clean speech signal, the method comprising:

determining a channel response of an alternative sensor to ambient noise;

determining a parameter of a prior probability distribution for clean speech values from a value of an air conduction microphone signal; and using the channel response and the prior probability distribution for clean speech values to determine a clean speech value.

* * * * *